United States Patent [19]

Jansson

[11] Patent Number: 4,637,443

[45] Date of Patent: Jan. 20, 1987

[54] SAW ASSEMBLY

[75] Inventor: Kurt Jansson, Mariannelund, Sweden

[73] Assignee: AB A. K. Eriksson, Mariannelund, Sweden

[21] Appl. No.: 774,682

[22] Filed: Sep. 11, 1985

[30] Foreign Application Priority Data

Sep. 14, 1984 [SE] Sweden ..... 8404638

[51] Int. Cl.[4] ..... B27C 9/00; B27B 1/00

[52] U.S. Cl. ..... 144/39; 83/360; 83/367; 144/242 A; 144/242 E; 144/246 F; 144/357

[58] Field of Search ..... 144/357, 39, 242 A, 144/242 E, 246 F, 176; 83/360, 368, 371, 367

[56] References Cited

U.S. PATENT DOCUMENTS

| | | | |
|---|---|---|---|
| 3,692,074 | 9/1972 | Nilsson | 144/39 |
| 4,239,072 | 12/1980 | Merilainen | 144/357 |
| 4,440,203 | 3/1984 | Ostberg | 144/39 |
| 4,485,861 | 12/1984 | Nilsson | 144/39 |
| 4,548,247 | 10/1985 | Eklund | 144/39 |

*Primary Examiner*—W. D. Bray

*Attorney, Agent, or Firm*—Sughrue, Mion, Zinn, Macpeak and Seas

[57] ABSTRACT

A saw assembly for reducing logs while passing the logs at least once through the assembly and resawing the resultant sawn blocks while re-passing the blocks at least once through the saw assembly. The assembly comprises a pair of chippers (1) and at least one pair of band saws (2) located downstream thereof, and a pair of guide-and-feed devices (9) located between the chippers and the band saws. The components in each of these pairs of assembly units are located opposite one another on different sides of the center line of the saw line and are adjustable in relation to the center line. In order to simplify the construction and handling of the saw assembly, the saw assembly includes means (21) which, when reducing passing logs, cause the guide-and-feed devices (9) to synchronously accompany the setting movements of the chippers (1) in relation to the center of the saw line, and means (23) which, prior to a resawing operation, displace the guide-and-feed devices (9) in relation to the chippers (1) in a direction towards the center of the saw line, for engagement with the sawn block which is to be resawn into planks, this block passing free of the chippers.

9 Claims, 6 Drawing Figures

SAW ASSEMBLY

Figure 1:
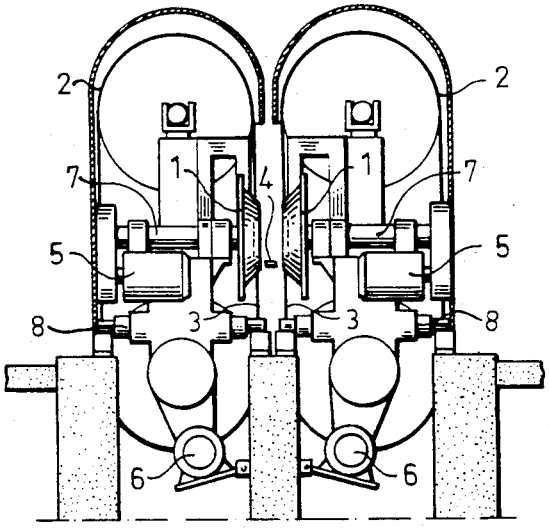
Fig. 1 PRIOR ART

The present invention relates to log-reducing saw assemblies of the kind in which the log is passed through the assembly at least once and the wood blocks thus obtained are re-sawn by passing the blocks back through the saw assembly at least once, the saw assembly comprising a pair of wood chippers and at least one pair of following band saws, and a pair of guide-and-feed devices located between the wood chippers and the band saws, each of these assembly units being located opposite one another on respective sides of the centre of the saw line and being adjustable in relation thereto.

Such saw assemblies are used to first block-saw the logs, i.e. to work a log so that it presents two parallel side surfaces, while simultaneously taking out one or more side planks. The block-sawn logs may then be passed through the saw assembly again and re-sawn or square sawn, i.e. to produce a block which presents two pairs of mutually parallel side surfaces, these two forms of sawn block being referred to hereinafter as "sawn block" and "re-sawn block" respectively. The resultant re-sawn block is then passed again through the saw assembly and divided into the desired number of planks. During their first two passes through the saw assembly, the peripheral surfaces of the logs are removed with the aid of the chippers. These chippers, however, do not come into contact with the resawn block during its third passage through the saw.

In known saw assemblies of this kind, guide surfaces are connected rigidly to the chippers downstream thereof, so as, inter alia, to prevent the log from twisting or rotating. Arranged downstream of the guide surfaces is a pair of centering feed devices, the major function of which is to feed and guide the re-sawn block to the band saws downstream thereof during the third pass through the assembly, although they may also be active in connection with reducing the logs. The band saws, chippers, the guide surfaces associated therewith, and the feed devices are all late rally displaceable, so that they can be set to desired sawing measurements. This lateral displacement of the respective units is effected along separate guides with the aid of associated piston-cylinder devices. This has meant that the feed-device guides and operating rams must be given a relatively long length, so as to be able to follow the movements of the other units. In addition to increasing costs, this separate feed-device guide means can also cause problems when setting-up the saw assembly and making adjustments thereto, which can lead to stoppages in production. For example, various adjustment procedures must be followed when adjusting the chipper settings, and it is necessary to carry out these procedures in exactly the right sequence and with great precision, if the desired result is to be achieved. If, for example, the chippers are not set symmetrically, the feed device will be subjected to very high stresses, which are also liable to affect the band saws.

The object of the present invention is to provide a saw assembly of the aforesaid kind which is of simpler construction and of cheaper manufacture than prior known saw assemblies of this kind, and which, above all, can be operated more simply and affords greater flexibility with regard to the aforementioned setting procedures than said prior art assemblies.

This object is achieved by means of a saw assembly constructed in accordance with the invention in which the feed devices are designed in a manner which also enables them to function as guide surfaces and to be connected therewith to the chippers, and to be disengaged from the chippers during a re-sawing operation, so as to operate as centering feed devices.

One characteristic feature of this saw assembly resides in the provision of means which, when dividing or reducing passing logs, are effective to cause the guide-and-feed devices to follow synchronously the setting movements executed by the chippers in relation to the centre of the saw line; and of means which, prior to a re-sawing operation, are effective to displace the guide and feed devices relative to of the chippers towards the saw-line centre, for engagement with the wood block to be divided, this block passing free of the chippers.

By allowing the feed devices to be guided by movement of the chipper when reducing logs, no separate adjustments need be made to these feed devices. In addition, since it is possible to displace the guide-and-feed devices relative to the chippers, said devices can also be used as feed devices when re-sawing blocks which are not affected by the chippers. Neither is there any need for long-stroke rams for operating the feed devices.

Each of the guide-and-feed devices is preferably mounted in its respective holder, which is mechanically connected to a respective chipper so as to accompany the adjusting or setting movements thereof, means conveniently being provided for permiting limited displacement of the guide-and-feed device holders relative to respective chippers.

In order to obviate the need for excessively long holder guides, the holders are suitably carried by an arm rigidly connected to the chipper holder means.

In order, inter alia, to ensure that the feed devices abut resiliently against a block to be re-sawn, the aforesaid means for displacing the guide-and-feed devices relative to the chippers suitably incorporate pneumatic piston-cylinder devices.

In accordance with one beneficial embodiment, the saw assembly incorporates means operative to centre the guide-and-feed devices relative to a centre line between the chippers prior to a re-sawing operation. In accordance with one embodiment hereof, this can be achieved through means incorporating a two-arm lever which is pivotally connected to two link arms, which are in turn each connected to a respective guide-and-feed device.

Alternatively, each guide-and-feed device may be connected to the piston rod of at least one double-acting hydraulic piston-cylinder device, the chambers of the said at least one piston-cylinder device being cross-coupled with opposite chambers of the hydraulic piston-cylinder device, or devices, of the other guide-and-feed device.

The centering means are preferably disengageable, in order to increase the flexibility of the saw assembly and to reduce the load on the centering arrangement when resetting the chippers.

When using double-acting hydraulic piston-cylinder devices and the centering function is disengaged, the aforesaid cross-coupling is effected in accordance with one preferred embodiment with the aid of a two-position fourway valve.

Figure 2:
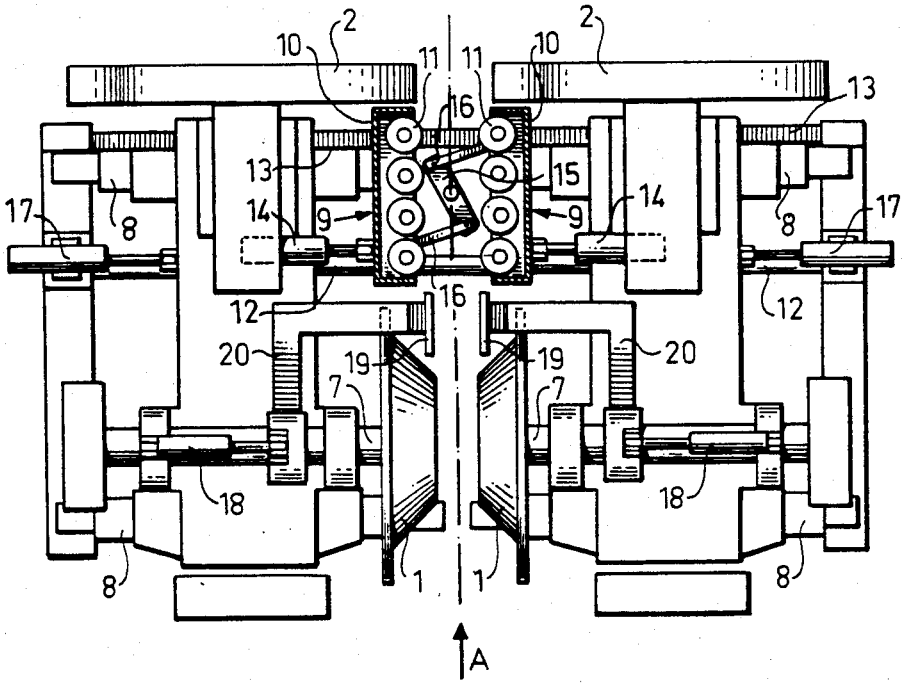
Fig. 2 PRIOR ART
Figure 3:
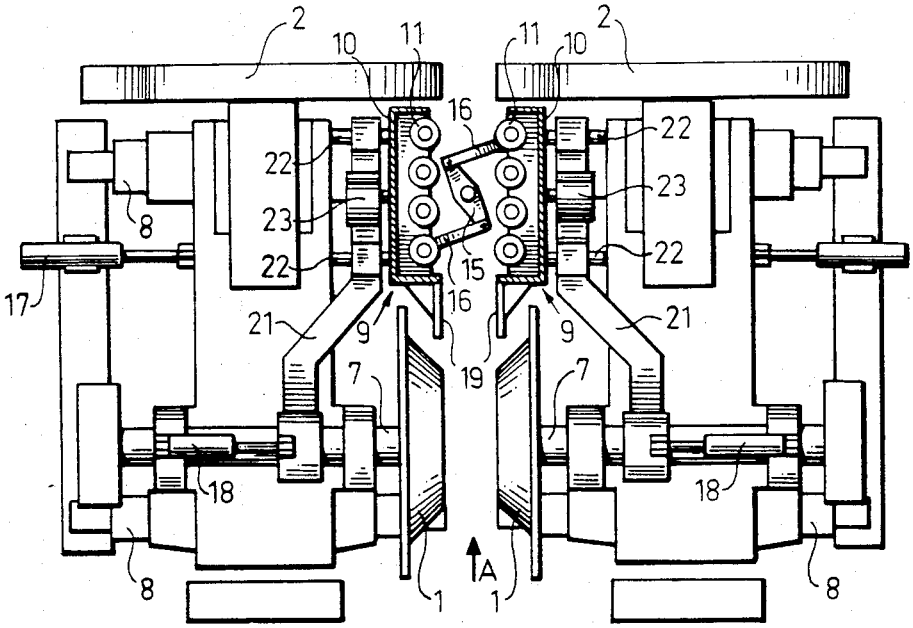
Figure 4:
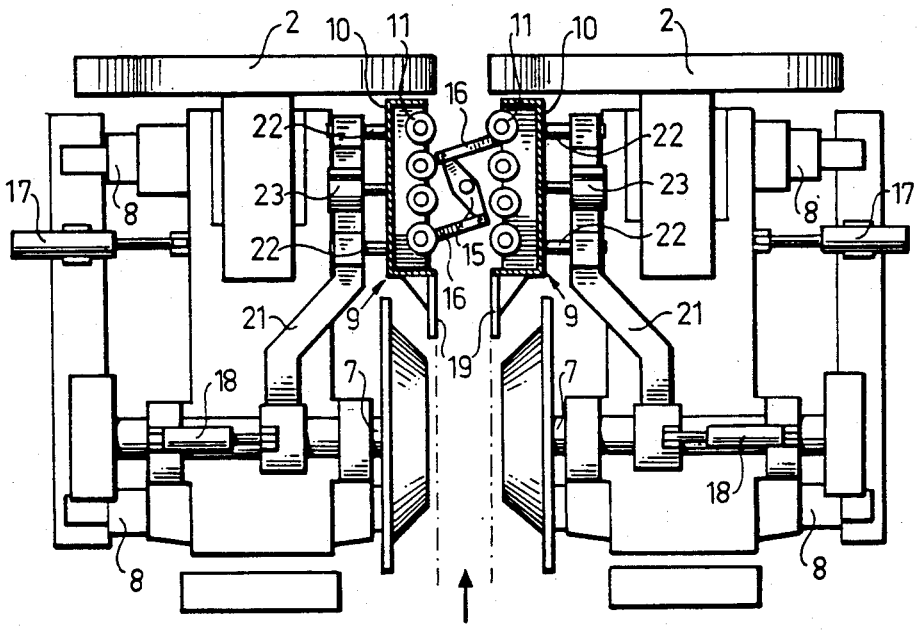
Figure 5:
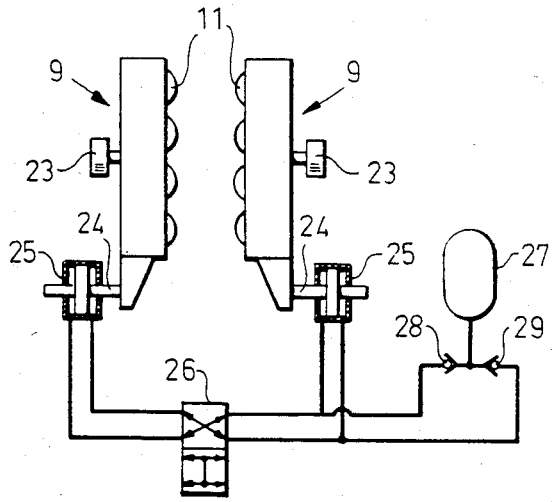
Figure 6:
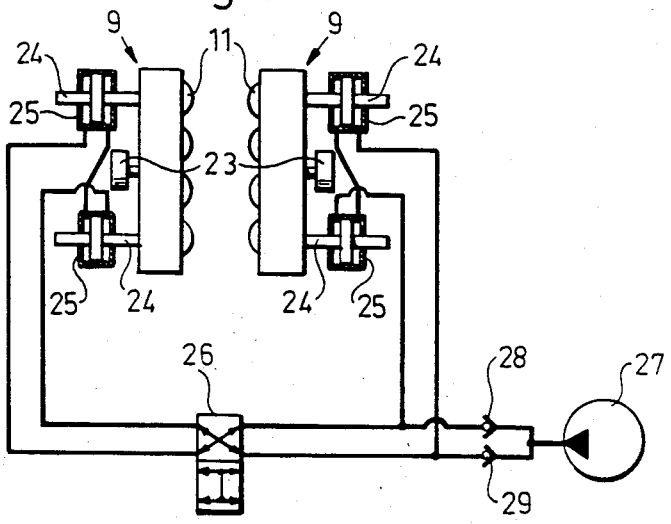

The invention will now be described in more detail with reference to accompanying drawings, in which FIG. 1 is a schematic side view of a saw assembly of the kind to which the present invention relates;

FIG. 2 is a schematic horizontal view of a known design of a saw assembly of the same kind as that illustrated in FIG. 1;

FIGS. 3 and 4 are schematic horizontal views of an assembly similar to the FIG. 1 assembly, but modified in accordance with the present invention; and FIGS. 5 and 6 illustrate schematically two alternative methods of guiding the feed devices in the saw assembly illustrated in FIGS. 3 and 4.

The saw assembly illustrated in FIG. 1 is intended both for reducing and for re-sawing wood block. To this end the assembly incorporates two mutually opposed chippers 1 and two band saws 2 located downstream thereof and equipped with saw bands 3. Reference numeral 4 identifies a support surface for the material to be sawn and fed through the apparatus. Respective chippers 1 are driven by motors 5, whereas the respective band saws are driven by motors 6. The chippers 1 are laterally adjustable on shafts 7, and the saws 2 can be adjusted to desired sawing measurements by lateral displacement on guides 8.

FIG. 2 is a horizontal schematic view of a saw assembly of the same kind as that shown in FIG. 1, and it will be seen from FIG. 2 that located between the chippers 1 and the band saws 2 are two mutually opposing feed devices 9. Each feed device comprises a holder 10 having journalled thereon a plurality of feed-and-guide rollers 11, which are driven by a motor not shown. The feed devices 9 are guided and supported by a front round-guide 12 and a rear flat-guide 13, and can be moved along these guides by means of a pneumatic piston-cylinder device 14. In order to ensure that when setting the positions of the two feed devices 9 they move synchronously relative to the centre line of the assembly, the feed devices are mutualy joined by means of a two-arm lever bar 15 which is journalled on the centre line of the assembly and pivotally connected with two link arms 16, each of which is connected to its respective feed device 9.

As will be seen from FIG. 2, respective saw frames are displaced by means of a hydraulic piston-cylinder device 17, and the chippers 1 can be displaced relative to the saw frame with the aid of hydraulic piston-cylinder devices 18. Arranged between the chippers 1 and the feed devices 9 are guide surfaces 19 which are firmly connected to rigid mounting arms 20 and thereby caused to accompany movement of respective chippers when setting the positions thereof.

The aforedescribed saw assembly has the following mode of operation: A log is fed into the saw assembly in the direction of the arrow A and there reduced along two mutually opposing side surfaces by the chippers 1, which hack the log edges into chips. The guide surfaces 19 lie against the thus reduced surfaces in order to prevent the log from twisting or turning. The feed devices 9 can be set to positions in which they afford additional guidance to the log while feeding the log to the band saws 2, each of which band saws cuts a side plank therefrom. The resultant block-sawn log is then normally rotated through 90° and passed through the saw assembly again, to obtain the aforesaid re-sawn block presenting two pairs of mutually parallel side surfaces. The re-sawn block is then taken through the saw assembly for a final time, with the chippers 1 and support surfaces 19 withdrawn out of contact with the block. The block is therewith guided and advanced between the saws 2 with the aid of the feed devices 9, this latter function being the major function of the feed devices 9 in prior art saw assemblies of this kind.

It must be emphasized that although the assemblies illustrated in FIG. 2 and the hereinafter described FIGS. 3 and 4 are shown, for the sake of simplicity, to include solely two band saws, in practice such saw assemblies normally incorporate one or two additional band saws located immediately downstream of the illustrated band saws. This enables more side planks to be taken from the block, and also enables the final, re-sawn or square-sawn block to be divided more finely.

Although the saw assembly illustrated in FIG. 2 generally fulfils its function effectively, it is nevertheless encumbered with certain disadvantages. The most serious of these disadvantages lies in the difficulties encountered when adjusting the various saw elements in relation to one another and to the centre line of the saw assembly with the desired degree of accuracy, which means that minor adjustments necessary to some saw component or the other for some reason or another becomes excessively time consuming and is liable to result in other setting errors, which can result in stoppages in operation.

One reason for these difficulties experienced when adjusting the setting of the various saw-assembly components is because the positional settings of the feed devices 9 are effected quite independently of the saws 2 and the chippers 1. This normally means guiding the feed devices on long guides 12,13 and moving the guides with long-stroke pneumatic piston-cylinder devices 14, since it must be possible for the feed devices to be displaced over the same distance as, for example, the saws 2.

FIGS. 3 and 4 illustrate a modification according to the invention to the saw assembly illustrated in FIG. 2, this modified version of the FIG. 2 embodiment eliminating the aforementioned disadvantages. Corresponding components are identified in FIGS. 3 and 4 with the same references as those used in FIG. 2. The principle difference between the embodiment illustrated in FIGS. 3 and 4 and the saw assembly illustrated in FIG. 2 is that in the saw assembly constructed in accordance with the invention the feed devices 9 also function as a guide-and-feed device for the re-sawn block and as a guide surface for reducing logs. This enables the previously used guide surfaces 19 to be omitted or, as illustrated, to be connected to the feed devices.

To enable the feed devices 9 to fulfil their intended guide-surface function, the feed devices are connected to holder means for the chippers 1 through short-stroke piston-cylinder devices 23 and rigid arms 21. Among other things this means that the feed devices 9 will directly accompany the setting movements of the chippers, thereby eliminating the possibility of setting errors between these assembly components. Since, in accordance with the illustrated embodiment, the feed devices are suspended from rigid arms 21, it is no longer necessary to provide long guides for guiding the feed devices, since these devices can now be guided by short guides 22, which extend through the arms 21. In addition, the long-stroke pneumatic piston-cylinder devices 14 of the FIG. 2 embodiment can be replaced with corresponding short-stroke piston-cylinder devices 23 in accordance with the present invention, as illustrated. The length of stroke of the piston-cylinder devices need only correspond to the extent of the relative displacement between the feed devices 9 and the chippers 1 required in order to enable the feed devices to guide the, for example, re-sawn block into the saws 2, at the same time as the chippers are in a withdrawn position out of contact with the block. The pneumatic piston-cylinder devices 23 can therewith be replaced, for example, with simple pneumatic bellows supplemented with feed-device spring return means.

The saw-assembly embodiment illustrated in FIGS. 3 and 4 has the following operational mode. When block sawing or resawing a log, the saw-assembly components take the positions illustrated in FIG. 3, the chippers 1 hacking mutually opposing edge surfaces of the log into chips. The guide-and-feed devices 9 are therewith adjusted together with the chippers 1 and serve as block guide surfaces, to prevent rotation of the block. At this stage the mechanism for synchronising and centering the two feed devices in relation to the centre line of the saw assembly is suitably disengaged, since otherwise they would be subjected to high stresses, should the one chipper move more quickly than the other. In addition, this provides the possibility of intentionally adjusting the chippers and feed devices asymmetrically in relation to the saws.

When the log has been reduced, for example, to a re-sawn, or square sawn, block, by passing the log twice through the saw assembly, and the square-sawn block is to be resawn into planks, the chippers 1 are withdrawn by means of the hydraulic piston-cylinder devices 18 to a position in which they no longer engage the block, cf. FIG. 4. In order to enable the block to be guided and fed into the saws 2 in the manner desired, however, the pneumatic piston-cylinder devices 23 are activated, causing slight displacement of the feed devices 9 in relation to the chippers 1 towards the centre line of the saw assembly, so that the rollers 11 in the feed devices are able to guide and feed the block into the saws. The centering and synchronizing mechanism between the feed devices is reengaged at this stage of the working procedure, so that the block is advanced while centered precisely in relation to the band saws. This centering function is engaged suitably when the chippers 1 are located in their outer, terminal positions centered in relation to the saw bands, these outer terminal positions serving as reference positions.

The lever arm 15 need not be located centrally between the saws, since the same function can be achieved by placing said lever arm to one side and by correspondingly extending the link arms 16. In addition to a double-arm lever bar, the link arms when provided with racks at the outer ends thereof can be connected by means of a toothed wheel or the like, so as to achieve the same function as that aforedescribed.

FIG. 5 illustrates schematically a further alternative embodiment for achieving synchronous movement between the feed devices 9, these feed devices being operated by means of pneumatic piston-cylinder devices 23 as with the previously described embodiments. In this case each feed device is connected to the piston rod 24 of a double-acting hydraulic piston-cylinder device 25 for the purpose of detecting and synchronising movement of said feed devices, wherewith in the synchronising position the chamber of each cylinder is cross-coupled to the chamber of the other cylinder by means of a two-position, four-way magnetic valve 26. Consequently, if one feed device should move in one direction the other feed device will be forced to execute a corresponding movement. For the purpose of disengaging the feed devices, which mode in accordance with the aforegoing is utilized when reducing logs, the magnetic valves 26 are reversed so that all hydraulic circuits are connected together. When the saw assembly is placed in this state, an equilibrium is obtained in the quantities of oil between the various circuits, so as to compensate for any internal leakage. Compensation for external leakage is effected through an oil source 27 which is placed under a given pressure and which is connected to the various circuits via non-return valves 28 and 29.

FIG. 6 illustrates a development of the apparatus illustrated in FIG. 5, each feed device being connected to the piston rods 24 of two hydraulic piston-cylinder devices 25, mutually connected as shown. In the synchronising mode the two piston-cylinder devices are connected, with the corresponding hydraulic piston-cylinder devices of the other feed device via a two-position four-way valve 26, in the position shown in FIG. 6. This valve as with the previous embodiment, can be utilized for switching between the synchronising mode and a free mode. The embodiment illustrated in FIG. 6 affords the advantage of increased stability and allows the piston-cylinder devices 25 to be made so stable mechanically as to enable the devices to serve as guides for the feed devices 9, therewith obviating the need for providing the aforedescribed guides 22.

The invention has been described in the aforegoing with reference to certain embodiments thereof illustrated in the drawings. It will be obvious to those skilled in this art, however, that the structural details of the saw assembly can be modified or varied in several respects. For example, the requisite synchronisation and engagement-disengagement functions of the saw assembly can be achieved in a manner different to that described and illustrated. Similarly, connections between the feed devices and the chippers can be effected, for example, with the aid of hydraulic devices in addition to the illustrated mechanical components. The described pneumatic piston-cylinder devices can be replaced with hydraulic piston-cylinder devices, although pneumatic devices are preferred in respect of certain assembly components, since such devices afford cushioning possibilities through the compressibility of the air. As an alternative to enabling disengagement of the synchronisation between the two feed devices, the synchronising means can be made sufficiently robust and strong to enable these devices to transfer necessary forces between the feed devices.

What is claimed is:

1. A saw assembly for reducing logs by passing the logs at least once through the assembly and resawing the thus obtained blocks by re-passing the blocks through the saw assembly, comprising a pair of chippers and at least one pair of band saws located downstream of the chippers, and a pair of guide-and-feed devices located between the chippers and the band saws, the components in each of these pairs of assembly units being located opposite one another on different sides of the saw centre line and being adjustable in relation thereto, the saw assembly further comprising means operative to cause the guide-and-feed devices to accompany synchronously the setting movements of the chippers relative to the centre of the saw line when reducing passing logs; and means which are operative, prior to a resawing operation, to displace the guide-and-feed devices relative to the chippers in a direction towards the centre of the saw line for engagement with the wood block to be resawn, this block passing free from the chippers.

2. A saw assembly according to claim 1, wherein each of the guide-and-feed devices is mounted in a respective holder, these holders being mechanically connected to respective chipper for accompanying the setting movements thereof; and wherein means are arranged to provide limited displacement of the holders of said guide-and-feed devices in relation to respective chipper.

3. A saw assembly according to claim 2, wherein said holders are supported by an arm which is rigidly connected to respective chipper-holder means.

4. A saw assembly according to claim 1, wherein said means for displacing the guide-and-feed devices relative to the chippers include pneumatic piston-cylinder devices.

5. A saw assembly according to claim 1, comprising means operative to centre the guide-and-feed devices relative to a centre line between the chippers prior to effecting a resawing operation.

6. A saw assembly according to claim 5, wherein said means includes a two-arm lever bar, which is pivotally connected to two link arms, each of which is connected to a respective guide-and-feed device.

7. A saw assembly according to claim 5, wherein each guide-and-feed device is connected to the piston rod of at least one double-acting hydraulic piston-cylinder device; and wherein the chambers of the piston-cylinder device, or devices, of one guide-and-feed device are cross-coupled to opposite chambers of the hydraulic piston-cylinder device, or devices, of the other guide-and-feed device.

8. A saw assembly according to claim 5, wherein the centering means can be disengaged when using the assembly for reducing logs.

9. A saw assembly according to claim 7, comprising a two-position, four-way valve for effecting said cross-coupling and disengagement of the centering function when reducing logs.

* * * * *